US005857941A

United States Patent [19]

Maresh et al.

[11] Patent Number: 5,857,941

[45] Date of Patent: Jan. 12, 1999

[54] EXERCISE METHODS AND APPARATUS

[76] Inventors: Joseph D. Maresh, 19919 White Cloud Cir., West Linn, Oreg. 97068; Kenneth W. Stearns, 8009 Cedel, Houston, Tex. 77055

[21] Appl. No.: 837,984

[22] Filed: Apr. 15, 1997

[51] Int. Cl.[6] ..... A63B 69/16; A63B 22/04

[52] U.S. Cl. ..... 482/52; 482/51; 482/70

[58] Field of Search ..... 482/51, 52, 53, 482/57, 62, 70, 79, 80

[56] References Cited

U.S. PATENT DOCUMENTS

| | | | |
|---|---|---|---|
| 4,962,925 | 10/1990 | Chang | 482/62 |
| 5,529,554 | 6/1996 | Eschenbach | 482/57 |
| 5,529,555 | 6/1996 | Rodgers, Jr. | 482/57 |
| 5,540,637 | 7/1996 | Rodgers, Jr. | 482/52 |
| 5,542,893 | 8/1996 | Peterson et al. | 482/62 |
| 5,549,526 | 8/1996 | Rodgers, Jr. | 482/57 |
| 5,562,574 | 10/1996 | Miller | 482/51 |
| 5,573,480 | 11/1996 | Rodgers, Jr. | 482/57 |
| 5,573,481 | 11/1996 | Piercy et al. | 482/57 |
| 5,637,058 | 6/1997 | Rodgers, Jr. | 482/51 |

*Primary Examiner*—Stephen R. Crow
*Attorney, Agent, or Firm*—Mau & Krull, P.A.

[57] ABSTRACT

A crank is rotatably mounted on a frame, and a roller is rotatably mounted on the crank at a radially displaced location. A force receiving member and a discrete support member bear against the roller. The roller links rotation of the crank relative to the frame to up and down movement of both the force receiving member and the support member and to back and forth movement of the force receiving member relative to the support member.

26 Claims, 8 Drawing Sheets

Fig. 17
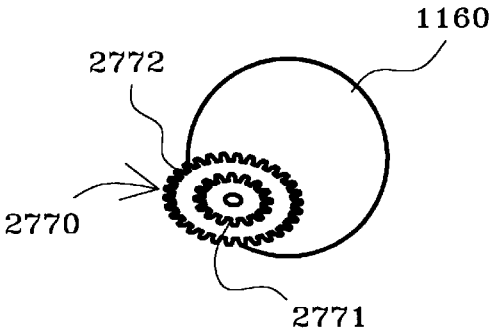
Fig. 18
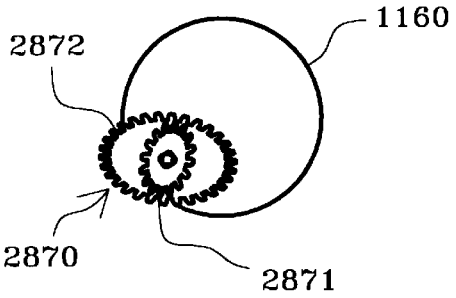
Fig. 19
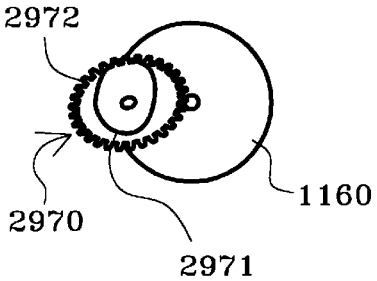
Fig. 20
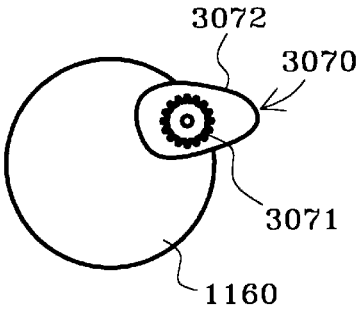
Fig. 21
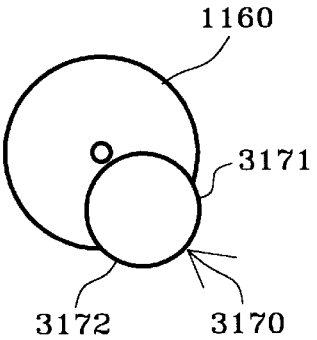
Fig. 22
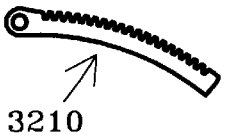
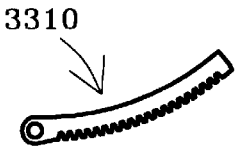
Fig. 23

EXERCISE METHODS AND APPARATUS

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Some examples of such equipment may be found in United States patents which are disclosed in an Information Disclosure Statement submitted herewith.

Exercise equipment has also been designed to facilitate full body exercise. For example, reciprocating cables or pivoting arm poles have been used on many of the equipment types discussed in the preceding paragraph to facilitate contemporaneous upper body and lower body exercise. Some examples of such equipment may be found in United States patents which are disclosed in an Information Disclosure Statement submitted herewith.

SUMMARY OF THE INVENTION

The present invention may be seen to provide a novel linkage assembly and corresponding exercise apparatus suitable for linking circular motion to relatively more complex, generally elliptical motion. In one embodiment, for example, a support member is pivotally mounted to a frame, and a force receiving member is movably mounted on the support member. A roller is rotatably mounted on a crank to support an opposite end of the support member and pivot the support member up and down in response to rotation of the crank. The force receiving member is linked to the crank in such a manner that movement of the force receiving member back and forth along the support member is linked to rotation of the crank. Thus, as the crank rotates, the linkage assembly constrains the force receiving member to travel through a generally elliptical path, having a relatively longer major axis and a relatively shorter minor axis. Moreover, the linkage is such that the major axis is longer than the effective diameter of the crank.

In another embodiment, for example, a roller is rotatably mounted on a crank and disposed between a force receiving member and a support member. Rotation of the crank causes the members to pivot up and down relative to the frame and the force receiving member to move back and forth relative to the support member. The roller may be provided with a first diameter and/or gear set to engage the force receiving member and a second diameter and/or gear set to engage the support member. Such a linkage may be used to move the force receiving member through a range of motion having a dimension longer than the effective crank diameter.

In another respect, the present invention may be seen to provide a novel linkage assembly and corresponding exercise apparatus suitable for linking reciprocal motion to relatively more complex, generally elliptical motion. In either of the foregoing embodiments, for example, a handle member may be pivotally connected to the frame; and a link may be interconnected between the force receiving member and a discrete, relatively lower portion of the handle member. As the force receiving member moves through its generally elliptical path, the handle member pivots back and forth relative to the frame member.

In yet another respect, the present invention may be seen to provide a novel linkage assembly and corresponding exercise apparatus suitable for adjusting the angle of the generally elliptical path of motion relative to a horizontal surface on which the apparatus rests. In any of the foregoing embodiments, for example, the support member may be pivotally mounted to a first frame member, and/or the force receiving member may be pivotally mounted to a pivoting handle member, either of which may be locked in one of a plurality of positions along a post. An increase in the elevation of the pivot axis, results in a relatively more strenuous, "uphill" exercise motion.

BRIEF DESCRIPTION OF THE DRAWINGS

With reference to the Figures of the Drawing, wherein like numerals represent like parts and assemblies throughout the several views.

FIG. 17 is a side view of an alternative roller arrangement suitable for use with the present invention;

FIG. 18 is a side view of another alternative roller arrangement suitable for use with the present invention;

FIG. 19 is a side view of yet another alternative roller arrangement suitable for use with the present invention;

FIG. 20 is a side view of still another alternative roller arrangement suitable for use with the present invention;

FIG. 21 is a side view of yet one more alternative roller arrangement suitable for use with the present invention;

FIG. 22 is a side view of an alternative rack arrangement suitable for use with the present invention; and FIG. 23 is a side view of another alternative rack arrangement suitable for use with the present invention.

DETAILED DESCRIPTION OF THE PREFERRED EMBODIMENT

Figure 1:
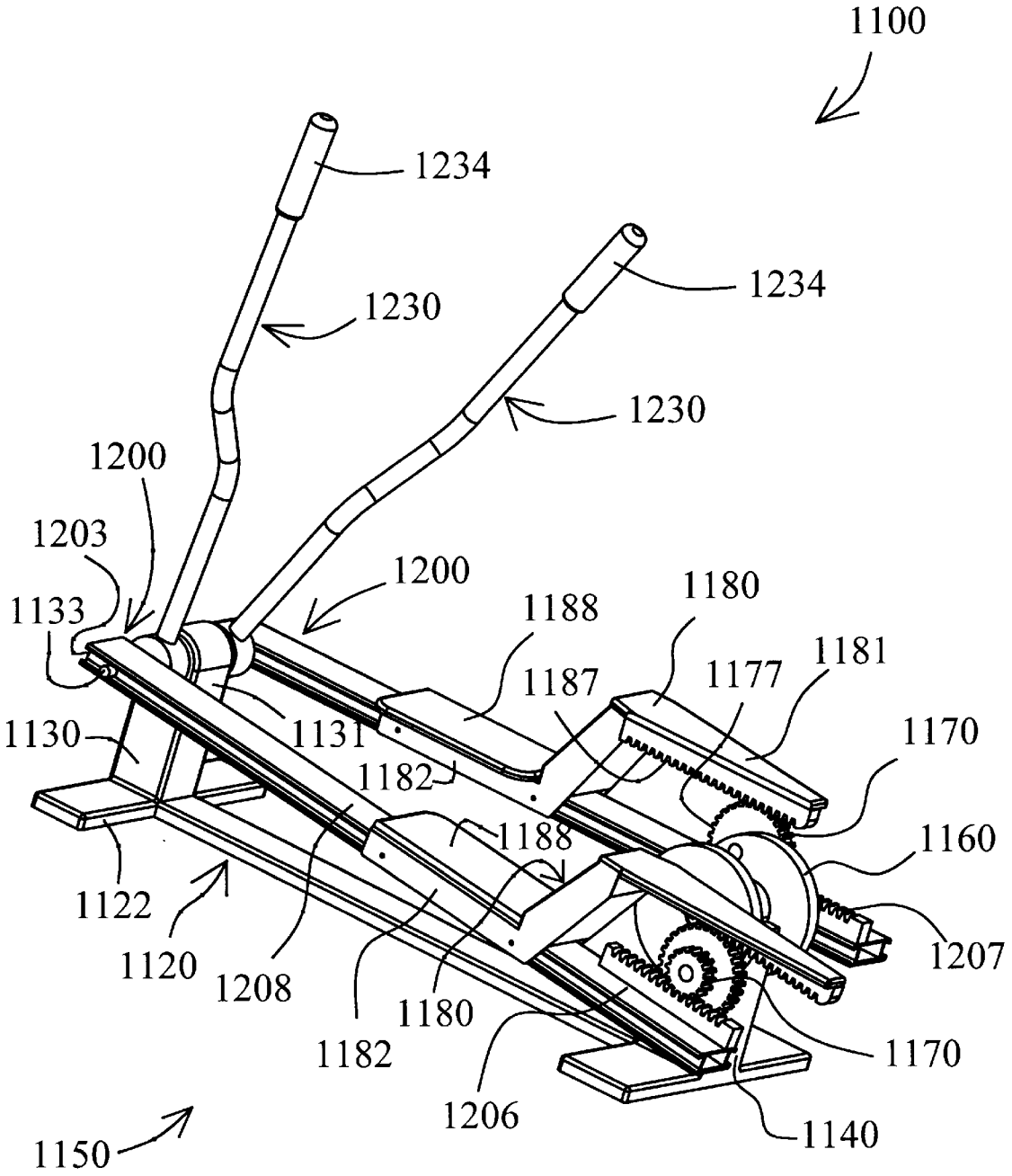
FIG. 1 is a perspective view of an exercise apparatus constructed according to the principles of the present invention.

An exercise apparatus constructed according to the principles of the present invention is designated as 1100 in FIGS. 1–5. The apparatus 1100 generally includes a frame 1120 and a linkage assembly 1150 movably mounted on the frame 1120. Generally speaking, the linkage assembly 1150 moves relative to the frame 1120 in a manner that links rotation of a flywheel 1160 to generally elliptical motion of a force receiving member 1180. The term "elliptical motion" is intended in a broad sense to describe a closed path of motion having a relatively longer first axis and a relatively shorter second axis (which extends perpendicular to the first axis).

The frame 1120 includes a base 1122, a forward stanchion or upright 1130, and a rearward stanchion or upright 1140. The base 1122 may be described as generally I-shaped and is designed to rest upon a generally horizontal floor surface 99 (see FIGS. 2 and 4–5). The apparatus 1100 is generally symmetrical about a vertical plane extending lengthwise through the base 1122 (perpendicular to the transverse ends thereof), the only exception being the relative orientation of certain parts of the linkage assembly 1150 on opposite sides of the plane of symmetry. In the embodiment 1100, the "right-hand" components are one hundred and eighty degrees out of phase relative to the "left-hand" components. However, like reference numerals are used to designate both the "right-hand" and "left-hand" parts on the apparatus 1100, and when reference is made to one or more parts on only one side of the apparatus, it is to be understood that corresponding part(s) are disposed on the opposite side of the apparatus 1100. Those skilled in the art will also recognize that the portions of the frame 1120 which are intersected by the plane of symmetry exist individually and thus, do not have any "opposite side" counterparts. Furthermore, to the extent that reference is made to forward or rearward portions of the apparatus 1100, it is to be understood that a person could exercise on the apparatus 1100 while facing in either direction relative to the linkage assembly 1150.

The forward stanchion 1130 extends perpendicularly upward from the base 1122 and supports a telescoping tube 1131. A plurality of holes 1138 are formed in the stanchion 1130, and at least one hole is formed in the upper end of the tube 1131 to selectively align with any one of the holes 1138. A pin 1128, having a ball detent, may be inserted through an aligned set of holes to secure the tube 1131 in a raised position relative to the stanchion 1130.

The rearward stanchion 1140 extends perpendicularly upward from the base 1122 and supports a bearing assembly. An axle 1164 is inserted through a laterally extending hole in the bearing assembly to support a pair of flywheels 1160 in a manner known in the art. For example, the axle 1164 may be inserted through the hole, and then a flywheel 1160 may be keyed to each of the protruding ends of the axle 1164, on opposite sides of the stanchion 1140. Those skilled in the art will recognize that the flywheels 1160 could be replaced by some other rotating member(s) which may or may not, in turn, be connected to one or more flywheels. These rotating members 1160 rotate about a crank axis which coincides with the longitudinal axis of the axle 1164.

A radially displaced shaft or support 1166 is rigidly secured to each flywheel 1160 by means known in the art. For example, the shaft 1166 may be inserted into a hole in the flywheel 1160 and welded in place. The shaft 1166 extends axially away from the flywheel 1160 at a point radially displaced from the crank axis, and thus, the shaft 1166 rotates at a fixed radius about the crank axis. In other words, the shaft 1166 and the flywheel 1160 cooperate to define a crank having a crank radius.

Figure 4:
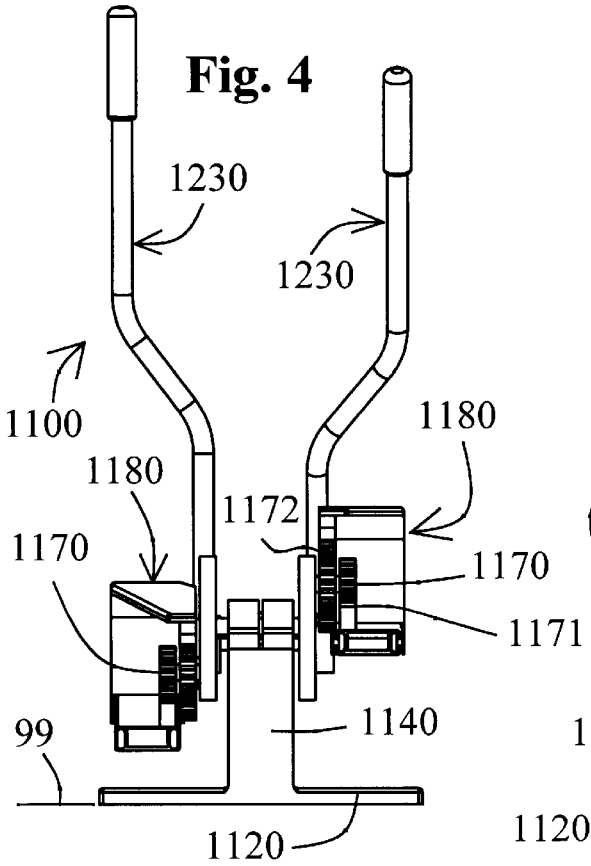
FIG. 4 is a rear view of the exercise apparatus of FIG. 1.
Figure 5:
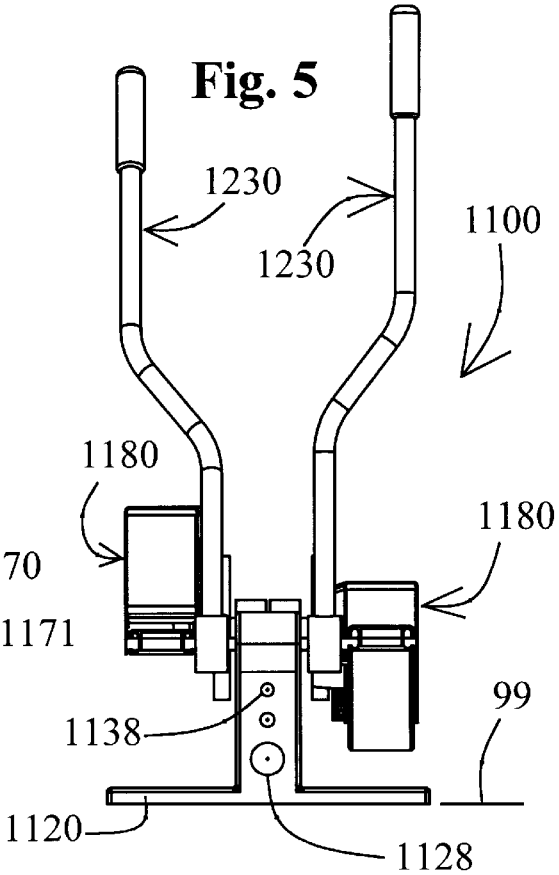
FIG. 5 is a front view of the exercise apparatus of FIG. 1.

A roller 1170 is rotatably mounted on each shaft 1166. The roller 1170 on the right side of the apparatus 1100 rotates about a roller axis which coincides with the longitudinal axis of the right shaft 1166, and the roller 1170 on the left side of the apparatus 1100 rotates about a roller axis which coincides with the longitudinal axis of the left shaft 1166. As shown in FIG. 4, the roller 1170 provides a first interface 1171 having a first effective diameter, and a second interface 1172 having a second, relatively smaller effective diameter. In this embodiment 100, gear teeth 1177 are disposed about the roller 1170 at the first interface 1171, and gear teeth 1178 are disposed about the roller 1170 at the second interface 1172.

Each force receiving member 1180 has a rearward portion or arm 1181 which overlies the first interface 1171. In this embodiment 100, a rack of gear teeth 1187 is disposed along the rearward portion 1181 and engages the gear teeth 1177 on the roller interface or pinion 1171. In view of this arrangement, the roller 1170 may be said to provide a means for interconnecting the flywheel 1160 and the force receiving member 1180. Each force receiving member 1180 has a forward portion 1182 which is rollably mounted on a respective rail or track 1200 in a manner known in the art. Each force receiving member 1180 provides an upwardly facing support surface 1188 sized and configured to support a person's foot. Thus, each force receiving member 1180 may be described as a foot skate.

Each rail 1200 has a forward end 1203, a rearward end 1206, and an intermediate portion 1208. The forward end 1203 of each rail 1200 is movably connected to the frame 1120, forward of the flywheels 1160. In particular, each forward end 1203 is rotatably connected to the forward stanchion 1130 by means known in the art. For example, a shaft 1133 may be inserted into a hole extending laterally through the tube 1131 and into holes extending laterally through the forward ends 1203 of the rails 1200. The shaft 1133 may be keyed in place relative to the stanchion 1130, and nuts may be secured to opposite ends of the shaft 1133 to retain the forward ends 1203 on the shaft 1133. As a result of this arrangement, the rail 1200 may be said to provide a discrete means for movably interconnecting the force receiving member 1180 and the frame 1120.

The rearward end 1206 of the rail 1200 underlies the second interface 1172 on the roller 1170. In this embodiment 1100, a rack of gear teeth 1207 is disposed along the rearward portion 1206 and engages the gear teeth 1178 on the roller interface or pinion 1172. In view of this arrangement, the roller 1170 may be said to provide a means for movably interconnecting the flywheel 1160 and the rail 1200, and the rail 1200 may be said to provide a discrete means for movably interconnecting the flywheel 1160 and the force receiving member 1180.

The intermediate portion 1208 of the rail 1200 may be defined as that portion of the rail 1200 along which the skate 1180 may travel and/or as that portion of the rail 1200 between the rearward end 1206 (which rolls over the roller 1170) and the forward end 1203 (which is rotatably mounted to the frame 1120). The intermediate portion 1208 may be generally described as having an I-shaped profile and/or a pair of C-shaped channels which open away from one another. Each channel 1209 functions as a guide for one or more rollers rotatably mounted on each side of the foot skate 1180. The skate 1180 cooperates with the roller 1170 to support the rear end 1206 of the rail 1200 above the floor surface 99.

Figure 2:
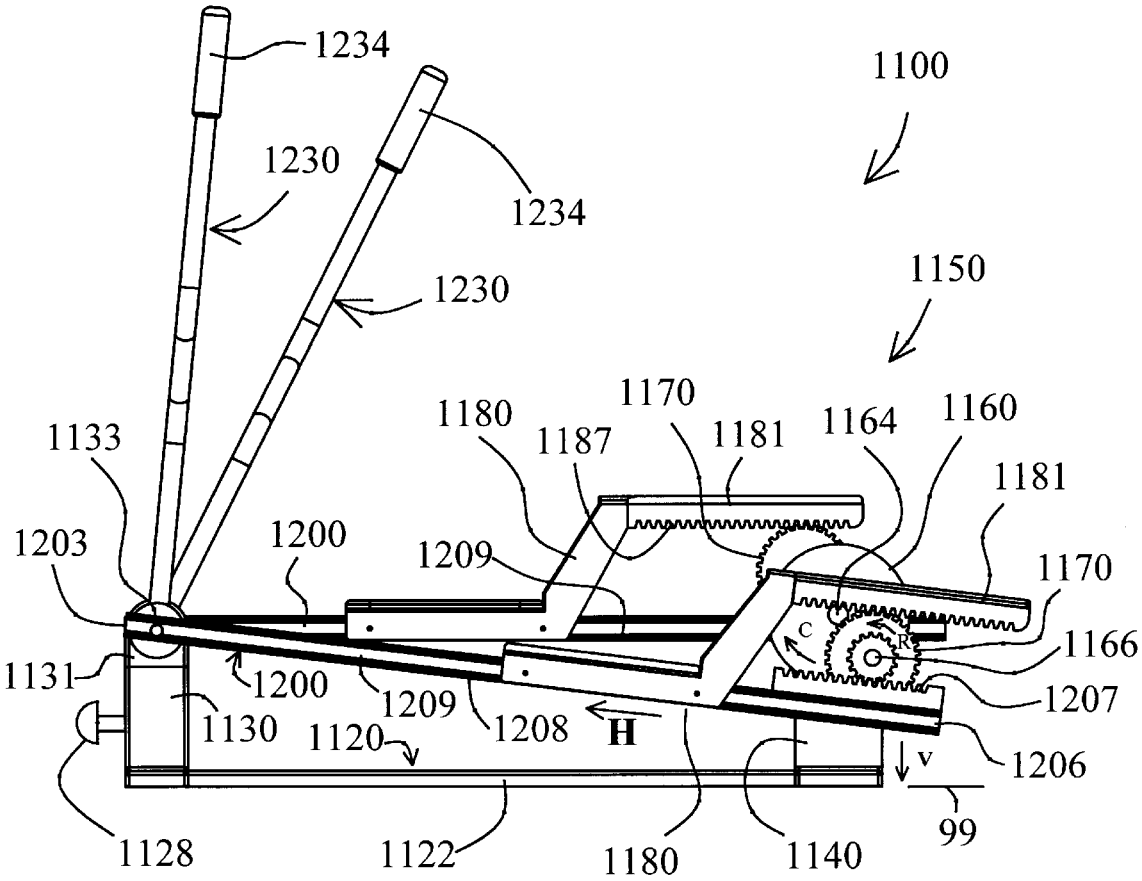
FIG. 2 is a side view of the exercise apparatus of FIG. 1.
Figure 3:
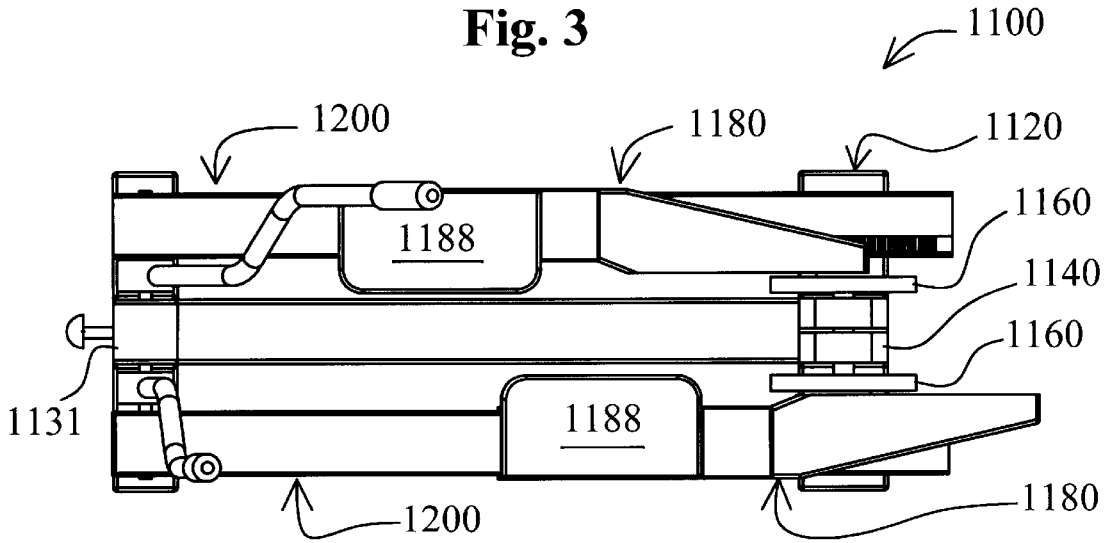
FIG. 3 is a top view of the exercise apparatus of FIG. 1.

Operation of the apparatus 1100 may be described with reference to FIG. 2, wherein arrows H, R, V, and C indicate how respective parts of the linkage assembly 1150 move relative to the frame 1120 and one another. The rack 1187 and pinion 1177 link movement of the force receiving member 1180 in the direction H to rotation of the roller 1170 in the direction R. The rail 1200 cannot move in the direction H because of its connection to the forward stanchion 1130. Thus, the force receiving member 1180 moves in the direction H relative to both the frame 1120 and the rail 1200. The rack 1207 and pinion 1178 link rotation of the roller 1170 in the direction R to forward movement of the roller 1170 along the rail 1200. In turn, the shaft 1166 links forward movement of the roller 1170 along the rail 1200 to rotation of the crank 1160 in the direction C. Since the rear portions of the force receiving member 1180 and the rail 1200 are supported by the roller 1170, rotation of the crank 1160 in the direction C is linked to movement of the force receiving member 1180 and the rail 1200 in the direction V.

Those skilled in the art will recognize that the extent or range of motion of the force receiving member 1180 in the direction V cannot exceed twice the radial distance between the crank axis and the roller axis. However, the extent or range of motion of the force receiving member 1180 in the direction H is a function of the diameter or gear ratio defined by the interfaces 1171 and 1172 and may exceed twice the radial distance between the crank axis and the roller axis. In the embodiment 1100, the range of motion in the direction H is approximately four times the noted radial distance.

Handle members 1230 are rotatably mounted to the frame 1120 in a manner known in the art to provide the option of exercising the upper body contemporaneously with exercise of the lower body. In particular, a lower end of each of the handle members 1230 is rotatably mounted on the shaft 1133 between the tube 1131 and a respective rail 1200. In this embodiment 1100, the handle members 1230 are independently movable relative to one another and the post 1131. Resistance to handle pivoting may be provided in the form of friction discs or by other means known in the art. Each handle member 1230 also includes an upper, distal portion 1234 which is sized and configured for grasping by a person standing on the force receiving member 1180.

Figure 6:
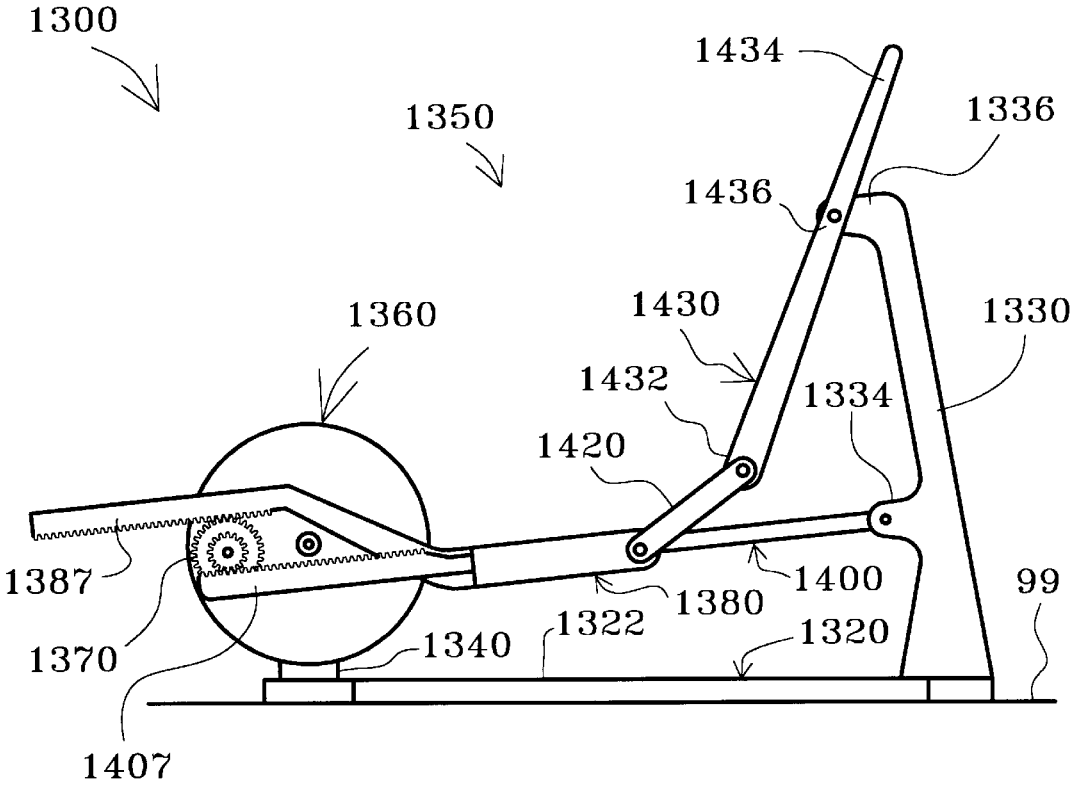
FIG. 6 is a side view of an alternative embodiment to the exercise apparatus of FIG. 1, with only one side of the linkage assembly shown.

An alternative to the embodiment 1100 is designated as 1300 and shown diagrammatically in FIG. 6. The embodiment 1300 is similar in many respects to the embodiment 1100 but has a handle member 1430 which is linked to a force receiving member 1380. Generally speaking, the handle member 1430 and the force receiving member 1380 are components of a linkage assembly 1350 which is movably connected to a frame 1320. The frame 1320 includes a base 1322, which rests upon a floor surface 99, a forward stanchion 1330, which extends upward from the front end of the base 1322, and a rearward stanchion 1340, which extends upward from the rear end of the base 1322.

A flywheel 1360 is rotatably mounted on the rearward stanchion 1340 and rotatable about a crank axis. A roller 1370 is rotatably mounted on the flywheel 1360 at a location radially displaced from the crank axis and cooperates with the flywheel 1360 to define a crank. The roller 1370 rotates about a roller axis relative to the flywheel 1360 and rotates with the flywheel 1360 about the crank axis. A first set of gear teeth, disposed at a relatively greater diameter about the roller 1370, engages a rack 1387 of gear teeth on the force receiving member 1380. A second set of gear teeth, disposed at a relatively smaller diameter about the roller 1370, engages a rack 1407 of gear teeth on a support member 1400. An opposite end of the support member 1400 is pivotally connected to a first trunnion 1334 on the forward stanchion 1330. The force receiving member 1380 is movably mounted on the support member 1400 intermediate the rack 1407 and the trunnion 1334.

A link 1420 is rotatably interconnected between the force receiving member 1380 and a lower end 1432 of a handle member 1430. An opposite, upper end 1434 of the handle member 1430 is sized and configured for grasping by a person standing on the force receiving member 1380. An intermediate portion 1436 of the handle member 1430 is pivotally mounted to a second, relatively higher trunnion 1336 on the forward stanchion 1330. The link 1420 links generally elliptical movement of the force receiving member to pivoting of the handle member 1430.

Figure 7:
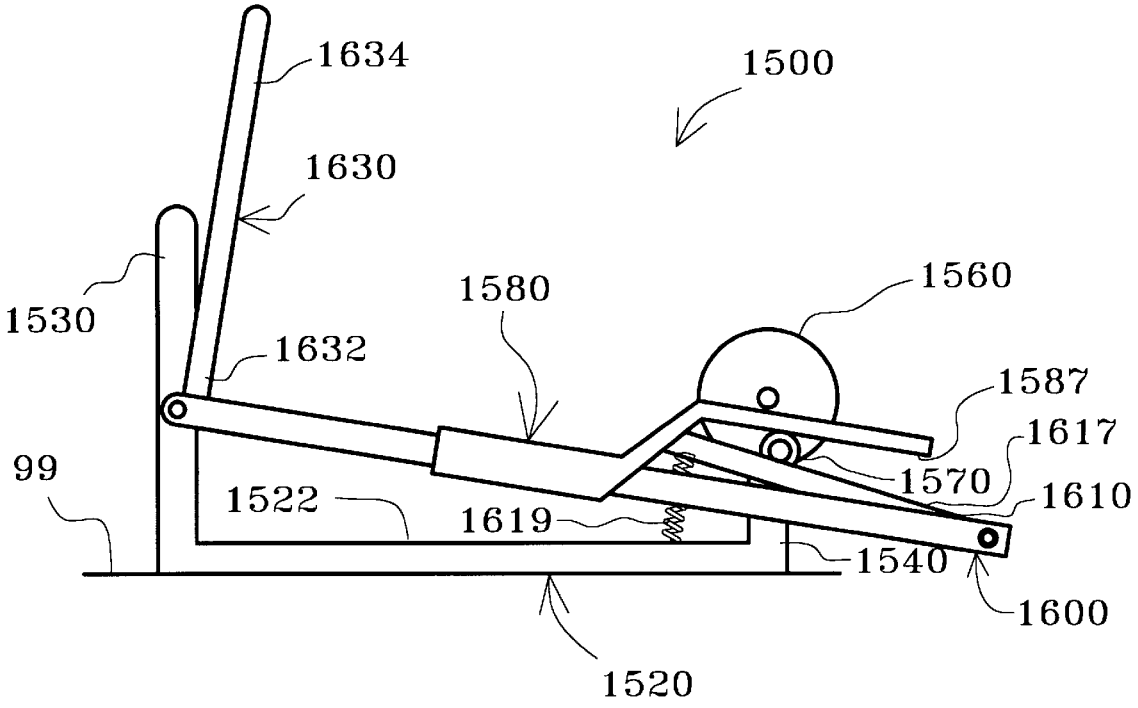
FIG. 7 is a side view of another alternative embodiment to the exercise apparatus of FIG. 1, with only one side of the linkage assembly shown.

Additional possible modifications involving the present invention may described with reference to the embodiment designated as 1500 in FIG. 7. Generally speaking, the exercise apparatus 1500 includes a frame 1320 having a base 1522, which rests upon a floor surface 99, a forward stanchion 1530, which extends upward from the front end of the base 1522, and a rearward stanchion 1540, which extends upward from the rear end of the base 1522.

A flywheel 1560 is rotatably mounted on the rearward stanchion 1540 and rotatable about a crank axis. A roller 1570 is rotatably mounted on the flywheel 1560 at a location radially displaced from the crank axis and cooperates with the flywheel 1560 to define a crank. The roller 1570 rotates about a roller axis relative to the flywheel 1560 and rotates with the flywheel 1560 about the crank axis. Rather than gear teeth, the roller 1570 simply has a first bearing surface or interface, disposed at a relatively greater diameter about the roller 1570, which engages a flat bearing surface 1587 on the force receiving member 1580, and a second bearing surface or interface, disposed at a relatively smaller diameter about the roller 1570, which engages a flat bearing surface 1617 on a support member 1600.

A rearward end of the support member 1610 is rotatably connected to a rearward end of a rail 1600. A helical coil spring 1619 is disposed between the base 1522 and an opposite, forward end of the support member 1610. The spring 1619 biases the bearing surface 1617 upward against the roller 1570. An opposite, forward end of the rail 1600 is rotatably connected to the forward stanchion 1530. The force receiving member 1580 is movably mounted on the rail 1600 intermediate the forward end and the rearward end. The rearward end of the rail 1600 is supported by the force receiving member 1580 which, in turn, is supported by the roller 1570.

A handle member 1630 has a lower end 1632 which is rigidly secured to the forward end of the rail 1600. An opposite, upper end 1634 of the handle member 1630 is sized and configured for grasping by a person standing on the force receiving member 1580. As a result of this arrangement, the handle member 1630 pivots together with the rail 1600 relative to the frame 1520.

Figure 10:
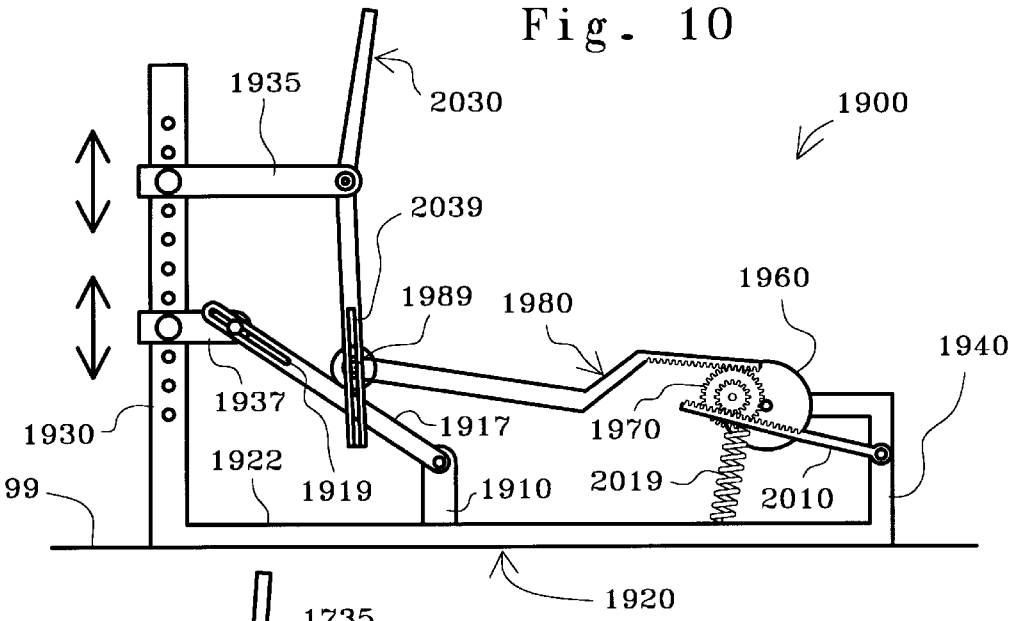
FIG. 10 is a side view of yet one more alternative embodiment to the exercise apparatus of FIG. 1, with only one side of the linkage assembly shown.
Figure 9:
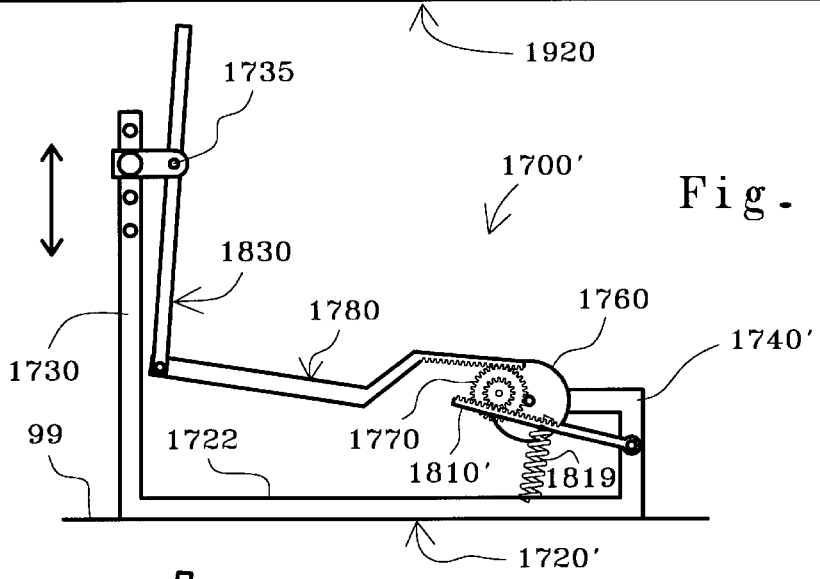
FIG. 9 is a side view of still another alternative embodiment to the exercise apparatus of FIG. 1, with only one side of the linkage assembly shown.
Figure 8:
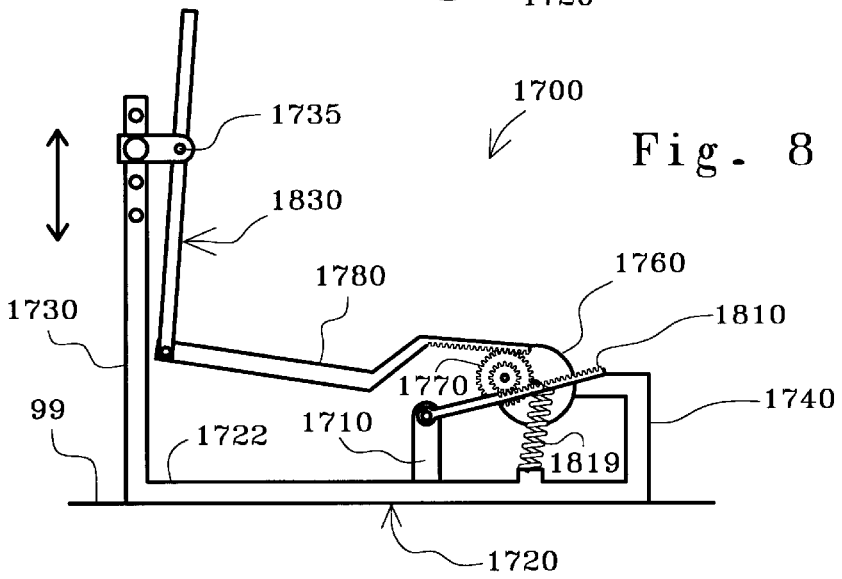
FIG. 8 is a side view of yet another alternative embodiment to the exercise apparatus of FIG. 1, with only one side of the linkage assembly shown.

Additional embodiments of the present invention are shown diagrammatically in FIGS. 8–10. The exercise apparatus designated as 1700 in FIG. 8 includes a frame 1720 having a base 1722, a forward stanchion 1730, a rearward stanchion 1740, and an intermediate stanchion 1710. A flywheel 1760 is rotatably mounted on the rearward stanchion 1740, and a roller 1770 is rotatably mounted on the flywheel 1760 at a radially displaced location. A first set of gear teeth, disposed at a relatively greater diameter about the roller 1770, engages a rack of gear teeth on a rearward portion of a force receiving member 1780. A second set of gear teeth, disposed at a relatively smaller diameter about the roller 1770, engages a rack of gear teeth on a support member 1810. A forward end of the support member 1810 is rotatably connected to the intermediate stanchion 1710. A helical coil spring 1819 is disposed between the base 1722 and the support member 1710 to bias the bearing surface on the latter upward against the roller 1770.

A forward end of the force receiving member 1780 is rotatably connected to a lower end of a handle member 1830. An opposite, upper end of the handle member 1830 is sized and configured for grasping by a person standing on the force receiving member 1780. An intermediate portion of the handle member 1830 is rotatably connected to a trunnion 1735 which, in turn, is slidably mounted on the forward stanchion 1730. A pin may be selectively inserted through aligned holes in the trunnion 1735 and the stanchion 1730 to secure the trunnion 1735 in any of several positions above the floor surface. As a result of this arrangement, pivoting of the handle member 1830 relative to the trunnion 1735 is linked to generally elliptical movement of the force receiving member 1780 relative to the frame 1720, which is linked to rotation of the flywheel 1760 relative to the frame 1720, which is linked to pivoting of the support member 1810 relative to the frame 1720.

As suggested by the many like reference numerals, the exercise apparatus designated as 1700' in FIG. 9 is similar in many respects to the apparatus designated as 1700 in FIG. 8. However, because the frame 1720' does not include an intermediate stanchion, the support member 1810' is reversed, and the rearward end thereof is rotatably mounted to the rearward stanchion 1740'.

The exercise apparatus designated as 1900 in FIG. 10 includes a frame 1920 having a base 1922, a forward stanchion 1930, a rearward stanchion 1940, and an intermediate stanchion 1910. A flywheel 1960 is rotatably mounted on the rearward stanchion 1940, and a roller 1970 is rotatably mounted on the flywheel 1960. A first set of gear teeth, disposed at a relatively greater diameter about the roller 1970, engages a rack of gear teeth on a rearward portion of a force receiving member 1980. A second set of gear teeth, disposed at a relatively smaller diameter about the roller 1970, engages a rack of gear teeth on a support member 2010. A rearward end of the support member 2010 is rotatably connected to the rearward stanchion 1940. A helical coil spring 2019 is disposed between the base 1922 and the support member 2010 to bias the latter upward against the roller 1970.

A roller 1989 is rotatably mounted on a forward end of the force receiving member 1980. The roller 1989 rolls or bears against a ramp 1917 having a first end rotatably connected to the intermediate stanchion 1910, and a second, opposite end connected to a trunnion 1937. A slot 1919 is provided in the ramp 1917 to accommodate angular adjustment of the ramp 1917 relative to the trunnion 1937 and the floor surface 99. In particular, the trunnion 1937 is slidably mounted on the forward stanchion 1930, and a pin may be selectively inserted through aligned holes in the trunnion 1937 and the stanchion 1930 to secured the stanchion 1937 in any of several positions above the floor surface. As the trunnion 1937 slides downward, the fastener interconnecting the trunnion 1937 and the ramp 1917 moves within the slot 1919.

A lower portion of a handle member 2030 is movably connected to the forward end of the force receiving member 1980, adjacent the roller 1989. In particular, a common shaft extends through the force receiving member 1980, the roller 1989, and a slot 2039 provided in the lower portion of the handle member 2030. An opposite, upper end of the handle member 2030 is sized and configured for grasping by a person standing on the force receiving member 1980. An intermediate portion of the handle member 2030 is rotatably connected to a trunnion 1935 which, in turn, is slidably mounted on the forward stanchion 1930 above the trunnion 1937. A pin may be selectively inserted through aligned holes in the trunnion 1935 and the stanchion 1930 to secure the trunnion 1935 in any of several positions above the floor surface. The slot 2039 in the handle member 2030 accommodates height adjustments and allows the handle member 2030 to pivot about its connection with the trunnion 2035 while the roller 1989 moves through a linear path of motion. As a result of this arrangement, the height of the handle member 2030 can be adjusted without affecting the path of the foot support 1980, and/or the path of the foot support 1980 can be adjusted without affecting the height of the handle member 2030, even though the two force receiving members are linked to one another.

Some additional modifications to the present invention are shown diagrammatically in FIGS. 11–16. Each of the embodiments 2100, 2200, 2300, 2400, 2500, and 2600 is shown with a linkage assembly in the absence of a frame. In each case, a flywheel 2160 is rotatably mounted on the frame, and a roller 2170 is rotatably mounted on the flywheel 2160 at a radially displaced location. A first roller interface engages a rear portion of a force receiving member 2180, and a second roller interface engages a support member 2190. The support member 2190 is rotatably connected to the frame and biased toward the roller 2170 by spring 2199. A roller 2189 is rotatably mounted on a forward end of the force receiving member 2180.

Figure 11:
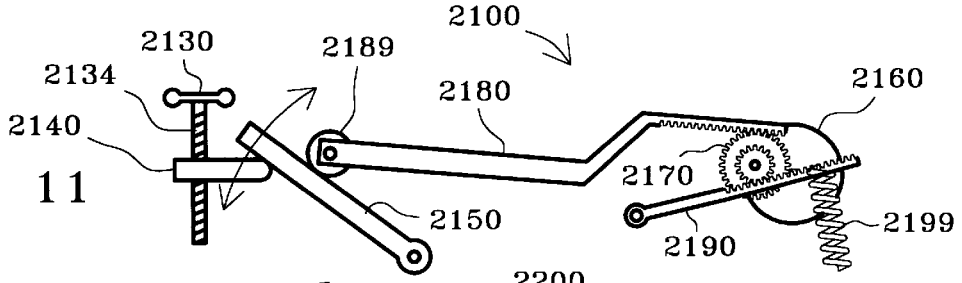
FIG. 11 is a diagrammatic side view of a first alternative arrangement for movably and adjustably connecting the force receiving member to the frame.

In the embodiment 2100 of FIG. 11, the roller 2189 rolls or bears against a flat or linear bearing surface on a ramp 2150. A relatively lower and rearward end of the ramp 2150 is rotatably connected to the frame, and a relatively higher and forward end of the ramp 2150 is supported by a flange or ledge 2140. A threaded hole is formed through the flange 2140 to accommodate a lead screw 2134 having a lower end rotatably connected relative to the frame. A knob 2130 on the lead screw 2134 is rotated to move the flange 2140 up or down along the lead screw 2134 and relative to the frame and thereby adjust the inclination of the ramp 2150 relative to the frame and the floor surface.

Figure 12:
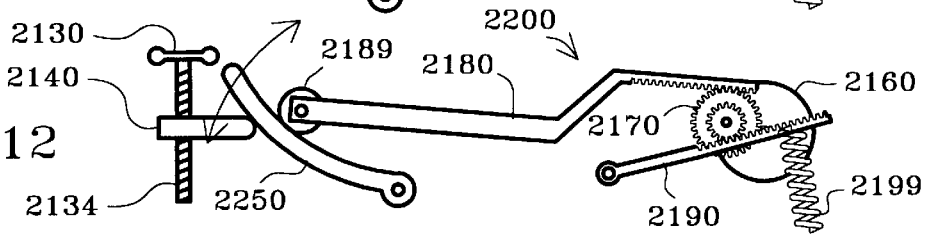
FIG. 12 is a diagrammatic side view of a second alternative arrangement for movably and adjustably connecting the force receiving member to the frame.

In the embodiment 2200 of FIG. 12, the roller 2189 rolls or bears against an arcuate or upwardly concave bearing surface on a ramp 2250. A relatively lower and rearward end of the ramp 2250 is rotatably connected to the frame, and a relatively higher and forward end of the ramp 2250 is supported by a flange or ledge 2140. The same lead screw arrangement is provided to adjust the inclination of the ramp 2250 to the frame and the floor surface.

Figure 13:
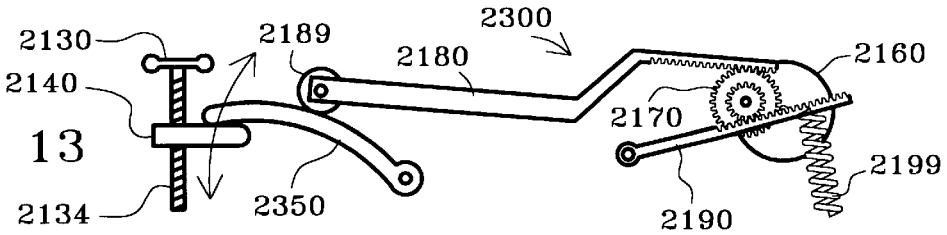
FIG. 13 is a diagrammatic side view of a third alternative arrangement for movably and adjustably connecting the force receiving member to the frame.

In the embodiment 2300 of FIG. 13, the roller 2189 rolls or bears against an arcuate or upwardly convex bearing surface on a ramp 2350. A relatively lower and rearward end of the ramp 2350 is rotatably connected to the frame, and a relatively higher and forward end of the ramp 2350 is supported by a flange or ledge 2140. The same lead screw arrangement is provided to adjust the inclination of the ramp 2350 relative to the frame and the floor surface.

Figure 14:
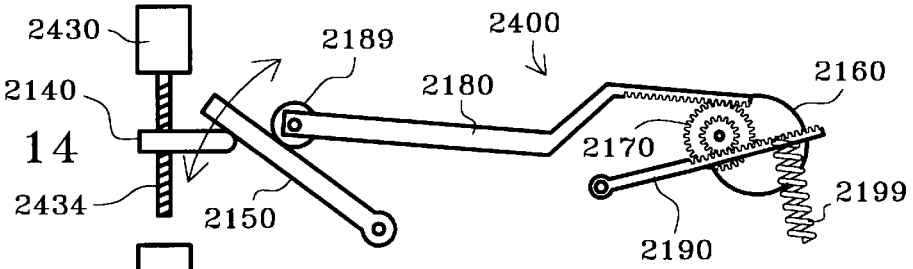
FIG. 14 is a diagrammatic side view of a fourth alternative arrangement for movably and adjustably connecting the force receiving member to the frame.

In the embodiment 2400 of FIG. 14, the roller 2189 rolls or bears against the same ramp 2150 as that shown and described with reference to FIG. 11 and the embodiment 2100. However, a different arrangement is provided to adjust the inclination of the ramp 2150 relative to the frame and the floor surface. In particular, the flange 2140 is connected to a shaft 2434 on a power driven adjustment device 2430, which could be a motor, for example. The device 2430 operates to move the flange 2140 up and down relative to the frame in response to a signal from either a computer controller or a user.

Figure 15:
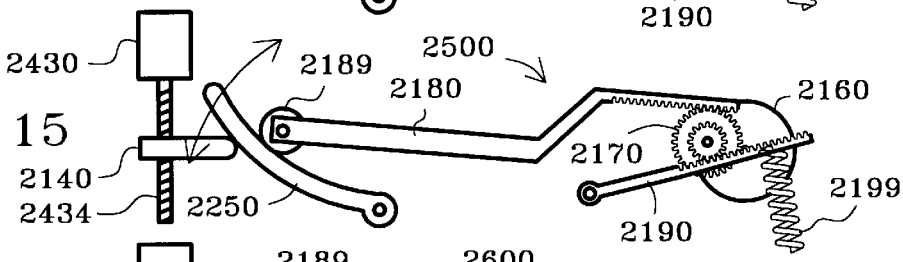
FIG. 15 is a diagrammatic side view of a fifth alternative arrangement for movably and adjustably connecting the force receiving member to the frame.

The embodiment 2500 of FIG. 15 is provided with the same ramp 2250 as that shown and described with reference to FIG. 12 and embodiment 2200, and with the same power driven adjustment arrangement as that shown and described with reference to FIG. 14 and the embodiment 2400.

Figure 16:
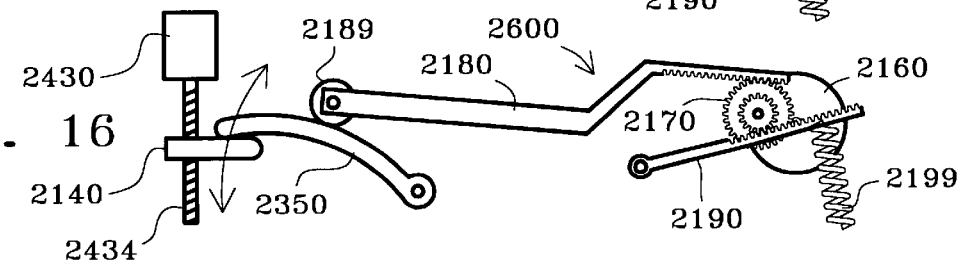
FIG. 16 is a diagrammatic side view of a sixth alternative arrangement for movably and adjustably connecting the force receiving member to the frame.

The embodiment 2600 of FIG. 16 is provided with the same ramp 2350 as that shown and described with reference to FIG. 13 and embodiment 2300, and with the same power driven adjustment arrangement as that shown and described with reference to FIG. 14 and the embodiment 2400.

Still more possible variations of the present invention are illustrated in FIGS. 17–21. In FIG. 17, an alternative roller 2770 is rotatably mounted on the flywheel 1160 of the embodiment 1100 shown in and described with reference to FIGS. 1–5. Each of the interfaces 2771 and 2772 may be described as having gear teeth disposed about an elliptical surface, wherein the major axes of the two interfaces are co-linear.

In FIG. 18, an alternative roller 2870 is rotatably mounted on the flywheel 1160 and provides interfaces 2871 and 2872 which have gear teeth disposed about elliptical surfaces. The major axes of the two interfaces 2871 and 2872 extend perpendicular to one another. Obviously, any two interfaces which are elliptical (or otherwise not entirely symmetrical) may be oriented so that the major axes occupy any angle relative to one another.

In FIG. 19, an alternative roller 2970 is rotatably mounted on the flywheel 1160 of the embodiment 1100 shown in and described with reference to FIGS. 1–5. The relatively smaller diameter interface 2971 may be described as having a smooth asymmetrical surface which provides a cam effect, and the relatively larger diameter interface 2972 may be described as having gear teeth disposed about an elliptical surface.

In FIG. 20, an alternative roller 3070 is rotatably mounted on the flywheel 1160 of the embodiment 1100 shown in and described with reference to FIGS. 1–5. The relatively smaller diameter interface 3071 may be described as having gear teeth disposed about a cylindrical surface, and the relatively larger diameter interface 3072 may be described as having a smooth asymmetrical surface which provides a cam effect.

In FIG. 21, an alternative roller 3170 is rotatably mounted on the flywheel 1160 of the embodiment 1100 shown in and described with reference to FIGS. 1–5. The two interfaces 3171 and 3172 may be described as having identical cylindrical surfaces. The embodiments of FIGS. 17–21 illustrate only a few of the many possible variations. Depending on the dimension and arrangement of parts, for example, the roller may not rotate through an entire cycle during exercise, in which case the interface surfaces need not extend all the way around the roller.

Still more possible variations of the present invention are illustrated in FIGS. 22–23. In FIG. 22, an alternative support member 3210 is shown as a possible substitute for the "underlying" rack and/or support member provided on any of the foregoing embodiments shown in FIGS. 1–16. The support member 3210 may be described as having a rack of gear teeth disposed along an upwardly convex surface.

In FIG. 23, an alternative support member 3310 is shown as a possible substitute for the "overlying" rack and/or force receiving member provided on any of the foregoing embodiments shown in FIGS. 1–16. The support member 3310 may be described as having a rack of gear teeth disposed along an downwardly convex surface.

Although the present invention has been described with reference to particular embodiments and applications, those skilled in the art will recognize additional embodiments, modifications, and/or applications which fall within the scope of the present invention. For example, in addition to the variations discussed above, one skilled in the art might be inclined to further provide any of various known inertia altering devices, including, for example, a motor, a "stepped up" flywheel, or an adjustable brake of some sort. Additionally, any or all of the components could be modified so that an end of a first component nested between opposing prongs on the end of a second component. Recognizing that, for reasons of practicality, the foregoing description and figures set forth only some of the numerous possible modifications and variations, the scope of the present invention is to be limited only to the extent of the claims which follow.

What is claimed is:

1. An exercise apparatus, comprising:

a frame designed to rest upon a floor surface;

a left crank and a right crank, wherein each said crank is rotatably mounted on the frame;

a radially displaced, axially extending member on the left crank;

a radially displaced, axially extending member on the right crank;

a left force receiving member and a right force receiving member, wherein each said force receiving member is sized and configured to support a foot of a standing person, and each said force receiving member is linked to a respective axially extending member in such a manner that each said force receiving member moves upward and downward relative to the frame as a respective crank rotates relative to the frame;

a left moving means, linked to the left force receiving member, for moving the left force receiving member and the left foot of the standing person forward and backward relative to the frame as the left crank rotates relative to the frame; and a right moving means, linked to the right force receiving member, for moving the right force receiving member and the right foot of the standing person forward and backward relative to the frame as the right crank rotates relative to the frame, wherein each said moving means includes a roller rotatably mounted on a respective axially extending member and rollable along a respective force receiving member.

2. The exercise apparatus of claim 1, wherein each said moving means further includes gear teeth disposed about the perimeter of a respective roller, and a rack of mating gear teeth disposed on a respective force receiving member and in contact with the gear teeth on the respective roller.

3. The exercise apparatus of claim 1, wherein each said roller is sandwiched between a respective force receiving member and a respective support member movably connected to the frame.

4. The exercise apparatus of claim 3, wherein each said support member has an end pivotally connected to the frame.

5. The exercise apparatus of claim 3, wherein a first roller diameter contacts a respective force receiving member, and a second roller diameter contacts a respective support member.

6. The exercise apparatus of claim 3, wherein a first rack of gear teeth is disposed on each said force receiving member to engage a first set of gear teeth disposed about a respective roller, and a second rack of gear teeth is disposed on each said support member to engage a second set of gear teeth disposed about a respective roller.

7. The exercise apparatus of claim 1, wherein each said force receiving member has a first end supported by a respective axially extending member, and a second, opposite end movably connected to the frame.

8. The exercise apparatus of claim 1, wherein each said moving means further includes a rail having a first end pivotally connected to the frame, and a second, opposite end in contact with a respective roller, and wherein each said force receiving member is movably mounted on a respective rail.

9. The exercise apparatus of claim 8, further comprising a left handle movably mounted on the frame and linked to the left force receiving member, and a right handle movably mounted on the frame and linked to the right force receiving member.

10. An exercise apparatus, comprising:

a frame designed to rest upon a floor surface;

a left crank and a right crank, wherein each said crank is rotatably mounted on the frame;

a radially displaced, axially extending roller rotatably mounted on the left crank;

a radially displaced, axially extending roller rotatably mounted on the right crank;

a left first member and a right first member, wherein each said first member has a first portion in contact with a respective roller, and each said first member is sized and configured to support a respective foot of a standing person; and a left second member and a right second member, wherein each said second member has a second portion in contact with a respective roller, and each said roller rolls against a respective first portion and a respective second portion to link rotation of a respective crank relative to the frame to generally elliptical movement of a respective first member and foot of the standing person relative to the frame.

11. The exercise apparatus of claim 10, wherein each said second member has an end pivotally connected to the frame.

12. The exercise apparatus of claim 10, wherein each said first member is movably mounted on a respective second member.

13. The exercise apparatus of claim 10, wherein each said first member is movably connected to the frame proximate an end opposite a respective crank.

14. The exercise apparatus of claim 13, wherein a left third member movably connects the left first member to the frame, and a right third member movably connects the right first member to the frame, and each said third member has a lower end, which is pivotally connected to a respective first member, an intermediate portion, which is pivotally connected to the frame, and an upper end, which is sized and configured for grasping by a person standing on each said first member.

15. The exercise apparatus of claim 10, wherein each said roller has a first diameter in contact with a respective first portion and a second diameter in contact with a respective second portion.

16. The exercise apparatus of claim 10, wherein the left first portion and the left roller cooperate to define a first rack and pinion, and the left second portion and the left roller cooperate to define a second rack and pinion, and the right first portion and the right roller cooperate to define a third rack and pinion, and the right second portion and the right roller cooperate to define a fourth rack and pinion.

17. The exercise apparatus of claim 10, wherein a spring biases each said second portion toward a respective roller.

18. The exercise apparatus of claim 10, wherein each said first member is disposed generally above a respective roller, and each said second member is disposed generally beneath a respective roller.

19. The exercise apparatus of claim 10, wherein contact between each said first member and a respective second member maintains a respective second portion in contact with a respective roller.

20. An exercise apparatus, comprising:

a frame designed to rest upon a floor surface;

a left crank and a right crank, wherein each said crank is rotatably mounted on the frame;

a radially displaced, axially extending member on the left crank;

a radially displaced, axially extending member on the right crank;

a left force receiving member and a right force receiving member, wherein each said force receiving member is sized and configured to support a foot of a standing person, and each said force receiving member is linked to a respective axially extending member in such a manner that each said force receiving member moves upward and downward relative to the frame as a respective crank rotates relative to the frame;

a left moving means, linked to the left force receiving member, for moving the left force receiving member and the left foot of the standing person forward and backward relative to the frame as the left crank rotates relative to the frame; and a right moving means, linked to the right force receiving member, for moving the right force receiving member and the right foot of the standing person forward and backward relative to the frame as the right crank rotates relative to the frame, wherein each said moving means includes a rail having a first end pivotally connected to the frame, and a second, opposite end in contact with a respective axially extending member, and each said force receiving member is movably mounted on a respective rail.

21. The exercise apparatus of claim 20, further comprising a left handle movably mounted on the frame and linked to the left force receiving member, and a right handle movably mounted on the frame and linked to the right force receiving member.

22. The exercise apparatus of claim 20, wherein each said moving means further includes a roller rotatably mounted on a respective axially extending member and rotatable relative to a respective force receiving member.

23. The exercise apparatus of claim 22, wherein each said moving means further includes gear teeth disposed about the perimeter of a respective roller, and a rack of mating gear teeth disposed on a respective force receiving member and in contact with the gear teeth on the respective roller.

24. The exercise apparatus of claim 22, wherein each said roller is sandwiched between a respective force receiving member and a respective rail.

25. The exercise apparatus of claim 22, wherein a first roller diameter bears against a respective force receiving member, and a second roller diameter bears against a respective rail.

26. The exercise apparatus of claim 22, wherein a first rack of gear teeth is disposed on each said force receiving member to engage a first set of gear teeth disposed about a respective roller, and a second rack of gear teeth is disposed on each said rail to engage a second set of gear teeth disposed about a respective roller.

* * * * *